US006767004B1

(12) United States Patent
Davis

(10) Patent No.: US 6,767,004 B1
(45) Date of Patent: Jul. 27, 2004

(54) REPLACEMENT MOTORIZED DRIVE UNIT FOR BOAT LIFTS

(75) Inventor: Bill Davis, Deerwood, MN (US)

(73) Assignee: Commander Products LLC, Crosby, MN (US)

( * ) Notice: Subject to any disclaimer, the term of this patent is extended or adjusted under 35 U.S.C. 154(b) by 0 days.

(21) Appl. No.: 10/388,256

(22) Filed: Mar. 13, 2003

(51) Int. Cl.[7] ..... B66D 1/14

(52) U.S. Cl. ..... 254/343; 254/346; 254/350; 114/48; 114/51

(58) Field of Search ..... 254/342, 343, 254/346, 347, 350, 368; 114/45, 48, 51

(56) References Cited

U.S. PATENT DOCUMENTS 2,351,060 A * 6/1944 McLauthlin ..... 74/425
3,265,632 A * 8/1966 Leach ..... 516/105
3,667,312 A * 6/1972 Dahl ..... 74/425
3,697,049 A * 10/1972 Wallace ..... 254/343
3,788,607 A * 1/1974 Crooks ..... 254/343
3,811,657 A * 5/1974 Hoover ..... 254/367
3,817,494 A * 6/1974 Eckerdt ..... 254/330
4,569,423 A * 2/1986 Hirano ..... 254/343
4,613,273 A * 9/1986 Wagner ..... 414/463
4,954,011 A 9/1990 Stenson ..... 405/3
5,051,027 A 9/1991 Horton ..... 405/3
5,143,182 A 9/1992 Basta ..... 187/11
5,211,124 A 5/1993 Reiser ..... 114/44
5,284,325 A * 2/1994 Sasaki et al. ..... 254/274
5,660,373 A * 8/1997 Maslo et al. ..... 254/296
5,970,813 A * 10/1999 Parkins et al. ..... 74/425

* cited by examiner

*Primary Examiner*—Emmanuel M. Marcelo
(74) *Attorney, Agent, or Firm*—Westman, Champlin & Kelly, P.A.

(57) ABSTRACT

A drive motor arrangement for replacing manual drives on an existing boat lift winch shaft comprises a worm gear box with a worm driven by an integrally mounted motor on the worm gear box. A worm gear is mounted on a tubular cross shaft extending outwardly on opposite ends of the gear box. The bore of the cross shaft is of size to slide over an existing winch drive shaft. The tubular shaft has a drive connection that mates with the existing drive connection on the winch box shaft. As shown a disc that effects drives to a mating disc on the winch box shaft. After removing the manual ratchet and wheel on an existing winch shaft, the tubular shaft of the worm gear box can be put into place and a suitable fastener is used to hold the drive connection on the tubular shaft in engagement with the drive member on the winch shaft.

11 Claims, 5 Drawing Sheets

REPLACEMENT MOTORIZED DRIVE UNIT FOR BOAT LIFTS

BACKGROUND OF THE INVENTION

The present invention relates a drive unit that can be installed onto existing boat lifts in place of the normal hand wheel and ratchet drive used for driving a winch for manually lifting the boat lift, with a compact simple drive that utilizes a threaded worm driven a worm gear on a hollow shaft that fits over the existing winch drive shaft. A friction clutch is used to provide a power drive for the winch.

Many boat lifts have been made where large manual wheels operating through a ratchet will drive a lift or winch shaft through a friction drive. The hand wheel is normally drives a ratchet that will permit rotational movement in one direction until the ratchet is released, so that the wheel can be turned in angular increments with safety. A manual winch drive is shown in U.S. Pat. No. 5,211,124.

Boats are getting heavier, and the effort needed to raise and lower a boat out of water using a manual drive even when speed reducing drives are used between the manual wheel and the lift cable is becoming excessive. It is desirable to have a motor drive, but many of the existing lifts are not adapted to direct motor drives, until the advance of the present invention. A power unit that drives the outer rim of a manual winch wheel is shown in U.S. Pat. No. 4,959,011.

SUMMARY OF THE INVENTION

The present invention relates to a power unit that will mount onto an existing winch box shaft that has a drive disc that normally is operated manually through one or more friction plates, much like a clutch plate, and wherein an output shaft of a gear reduces drive by the drive motor can be placed directly onto the winch shaft once the ratchet and hand wheel are removed. A worm gear box is used as a gear reducer, and the gear box has a tubular output shaft on which the worm gear is mounted. A suitable motor, such as an air motor, a 12 volt DC electric motor, a hydraulic motor, or other type of motor that is reversible is integral with the gear box and is used for driving the input worm, that in turn drives the worm gear.

The tubular output shaft is selected to have an interior diameter so it will fit over the existing shaft of various models of boat lifts. Both ends of the shaft extends outside the gear box. One end of the shaft has a flange or disc fixed thereon that will bear against a friction disc, and the friction disc engages an existing drive disc on the winch shaft. The tubular output shaft is held in place on the winch shaft with a suitable nut. Washers or spacers can be used so that adequate compression is placed onto the friction drive disc for driving the winch.

Various types of winch boxes and winch shafts are used with the boat lifts that exist, and which are driven through a hand wheel. By modifying the nut used to hold the tubular output shaft, the gear box of the present invention can be adapted to provide drives to a wide range of different type of winch shafts.

While a flange and friction disc drive coupling is shown, jaw couplings, pin and receptacle coupling and other desired drives between the tubular shaft and the existing winch shaft can be used.

DETAILED DESCRIPTION OF THE PREFERRED EMBODIMENTS

Figure 1:
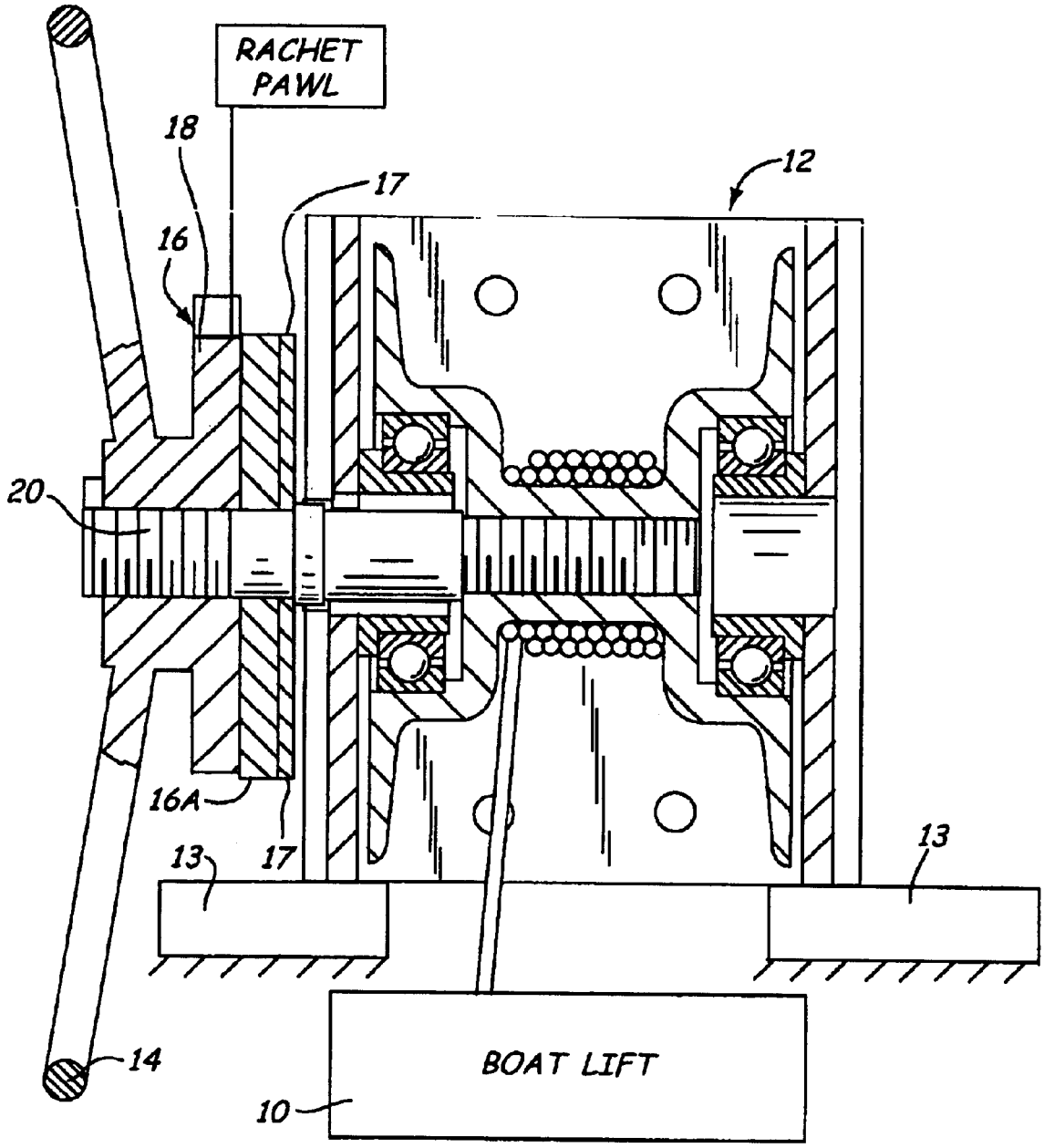
Fig. 1 PRIOR ART
FIG. 1 is a schematic representation of a boat lift that has a hand wheel for rotating a winch through a winch box to the boat lift.
Figure 4:
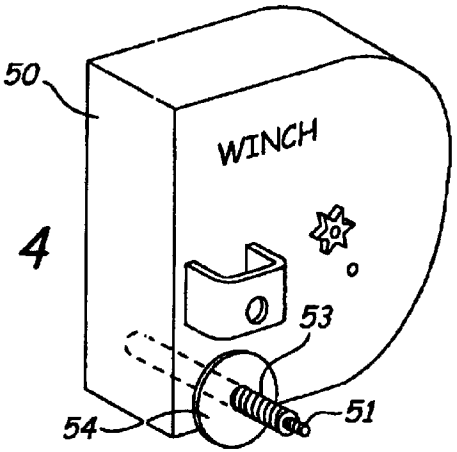
FIG. 4 is a perspective view of the winch box of FIGS. 2 and 3.

FIG. 1 is a schematic representation of a boat lift 10, that can be used to lift an existing boat, and which can be raised and lowered through the operation of a winch 12. The winch 12 is generally supported on a suitable support 13 to the shore or lake bottom, if in a lake, or onto a dock that is anchored to the ground. The winch conventionally has a large hand wheel 14 that is manually rotated, to rotationally drive the winch 12, through a friction clutch 16 which includes a friction disc 16A and a backing plate 17 fixed on a winch shaft 20. Many winches have speed reduction drives to increase the mechanical advantage for the hand wheel, but a direct connection is shown for simplicity.

A ratchet plate 18 is integral with hand wheel 14 and normally used between the hand wheel 14 and the friction drive 16, so that the wheel 14 can be moved in increments, and the wheel is released for a new grip, the ratchet pawl holds the wheel. The wheel is rotated to drive the winch and lift the boat through the boat lift 10. The ratchet pawl is released for lowering the boat.

The winch friction clutch 16 drives the winch shaft 20 as the wheel 14 is rotated. The wheel 14 is held in place on the shaft through a suitable nut 22 or it may be threaded directly onto the shaft 20, as shown, in some instances. The wheel 14 can be tightened down to create friction force against backing plate 17. The ratchet plate 18 is forced against friction disc 16A for driving the shaft 20. The ratchet plate 18 can be separate from the hand wheel 14 if desired.

Figure 12:
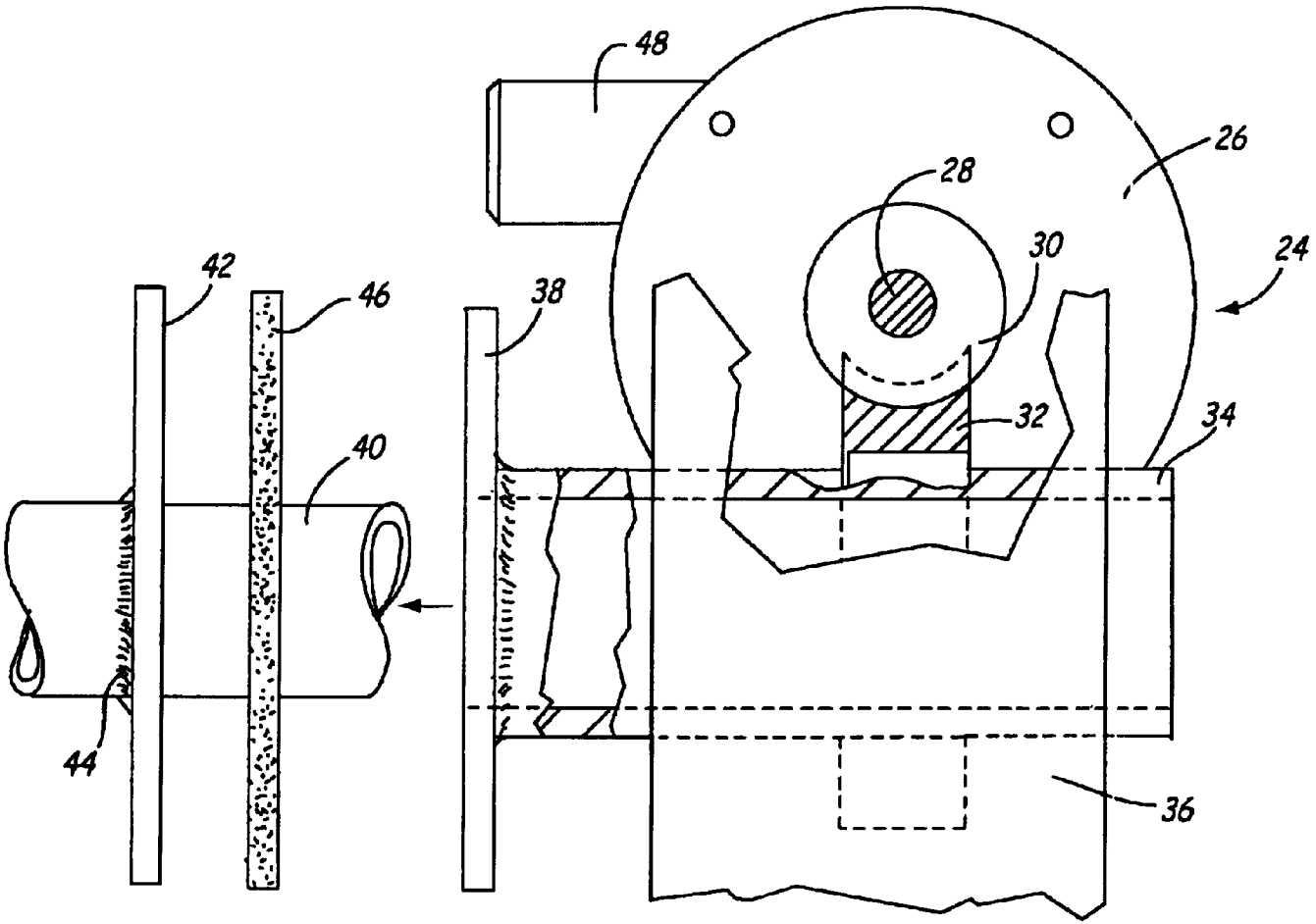
FIG. 12 is an exploded view of a typical mounting of the drive motor and gear reducer box of the present invention on an existing output shaft of a winch box.

The conversion power kit drive of the present invention is shown in FIGS. 2–12, and referring first to FIG. 12, an exploded view shows the conversion drive motor assembly 24, which includes a drive motor 26 that has an output shaft 28 that drives a worm 30, which in turn drives a worm gear 32. The worm 30 and worm gear 32 are mounted in a gear box 36. The worm gear 32 in turn drives a tubular shaft 34 that is shown broken away in FIG. 12. The tubular shaft 34 extends outwardly laterally beyond sides of the worm gear box 36 so ends of the shaft are outside the gear box. The shaft 34 is mounted in suitable bearings in the gear box. A drive coupling element or member, as shown, a flange or plate 38 is fixed at one end of the shaft 34.

A typical winch box drive shaft 40 from an existing winch (such as shaft 20) is illustrated schematically. The winch drive shaft 40 has a clutch backing disc or drive element 42 welded thereto as shown at 44. The disc 42 is a drive-coupling member or element for shaft 40, and is shown as an example of a member that mates with member 38 to in turn provide a drive coupling to shaft 40.

A clutch friction disc 46, which is also conventional on existing hand winches for boat lifts, is placed over the shaft 40. The disc 46 slides axially on shaft 40. The tubular shaft 34 is slid over the existing winch shaft 40 and secured in place with plate 38 bearing against disc 46, which is forced against plate 40 so that as the shaft 34 rotates it will also drive the shaft 40. The two parts of a drive coupling, 38 and 42 are thus mating and forms a drive connection.

The motor 26 is anchored with a suitable anchor shown at 48, only schematically, back to the boat lift frame, or to the dock, or to some other anchor. In other words, the load from the motor 26 that has to be reacted is reacted to a support. The drive is from the motor 26 through the worm 30, worm gear 32, and rotating tubular shaft 34 through the axially mating coupling members to the shaft 40. The worm 30 is a non-reversing drive, so that the motor. 26 is a reversible motor to drive the worm gear in opposite directions for raising and lowering the boat. The load on the winch from the boat lift will not reverse drive the worm gear.

Figure 2:
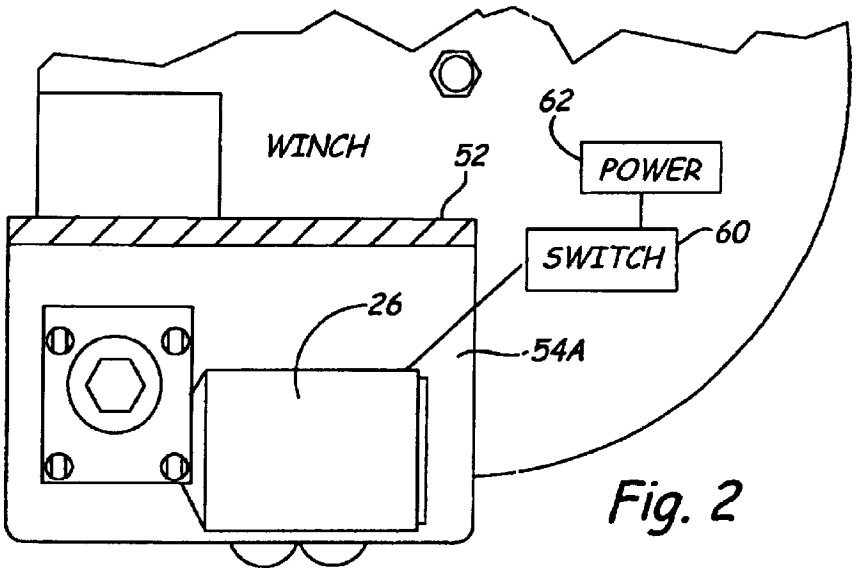
FIG. 2 is a side view of a typical installation of a drive motor made according to the present invention on a first type of boat lift winch box.
Figure 5:
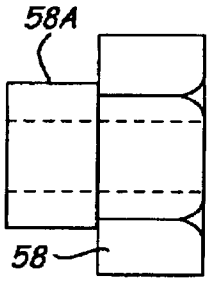
FIG. 5 is a side view of a nut used with the drive motor in FIGS. 2 and 3.
Figure 3:
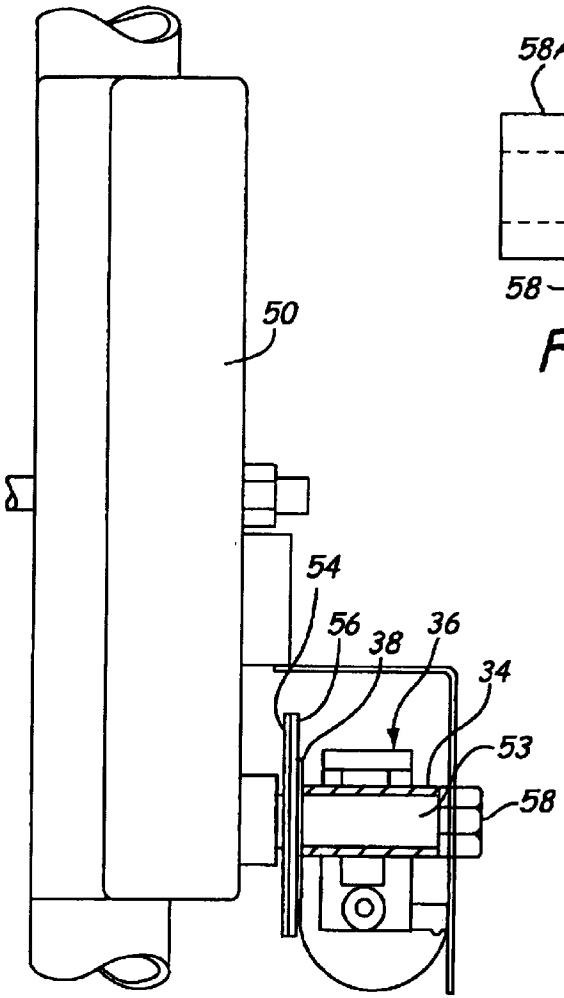
FIG. 3 is a front elevational view of the unit of FIG. 2.

FIGS. 2 and 3 show a first form of the winch or winch box 50, which has a drive motor attachment shown generally at 52 thereon, including an outer frame 54 that can be supported through suitable brackets and fasteners.

In this form of the invention, the motor 26 is driving the gear box 36, as previously shown. The winch box 50 input shaft 53 has a disc 54 fixed thereon. A suitable friction disc 56 bears against disc 54 and is forced toward disc 54 by the disc 38. The tubular shaft 34 is slid over the winch shaft 53, which is the same as shaft 40 in FIG. 12. The drive coupling parts on shafts 34 and 40 mate for driving as the shaft 34 is urged axially.

A nut 58 is threaded onto a smaller diameter threaded stud 51 (see FIG. 4) for holding the tubular shaft 34 and gear box 36 onto the winch shaft 52. The nut is tightened to urge the discs forming a clutch to create a drive path. The motor 26 then can be operated through a reversing switch 60, from a power source 62, which can be air, hydraulic, or electric. The nut 58 has a shank 58A that is the same outside diameter as the winch shaft 53, and the threaded interior fits on end stud 51. The gear box 36 is restrained from movement with a suitable bracket back to the winch box.

Figure 7:
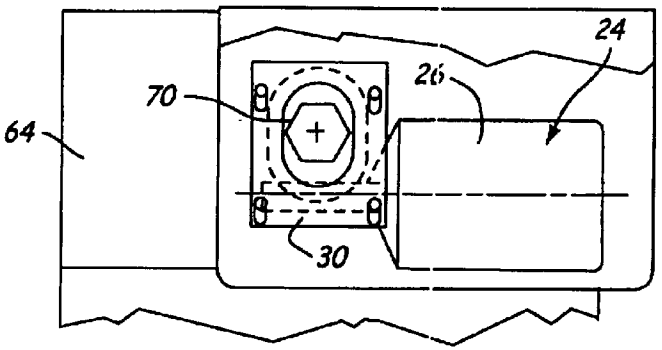
FIG. 7 is a fragmentary side view of the winch box of FIG. 6.
Figure 8:
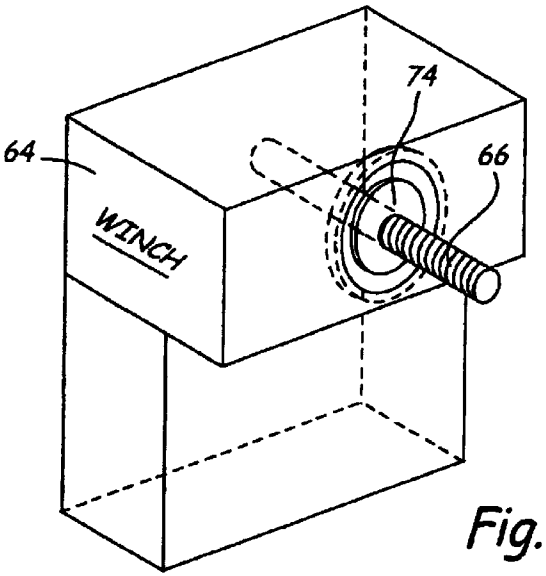
FIG. 8 is a perspective view of the winch box of FIGS. 6 and 7.
Figure 6:
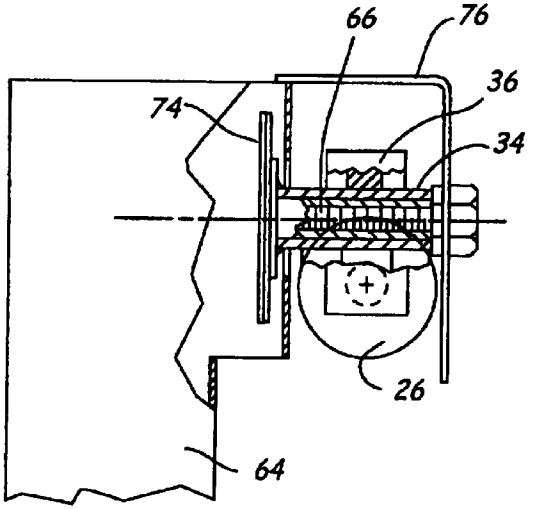
FIG. 6 is a front view of the drive unit mounted on a second type of boat lift.

In FIGS. 6, 7, and 8, the gear box 36 is mounted onto the second form of winch box 64, and in this form of the winch, there is a winch input drive shaft 66, for the winch or winch box 64.

In FIG. 8, the same winch 64 is shown to illustrate that the winch shaft 66 is a threaded shaft, as schematically shown. The shaft 66 is smaller in outside diameter than the inside diameter of tubular shaft 34. In this form of the invention, the nut 70 has a sleeve 71 that has an internal thread that threads onto shaft 66, and has an outer surface 72 that fits inside the tubular shaft 34 of the gear box 36. (see FIG. 6). The nut 70 then threads onto the shaft 66 and the sleeve 71 is inside the tubular shaft 34. The end of the nut 70 engages the outer end of shaft 34 and holds the gear box in position, with the friction disc 46 held against the plate 74 that is shown in this form of the invention as fixed to shaft 66.

All of the rest of the drive components are the same, and a suitable framework 76 can be used for supporting the gear box 36 in position and reacting loads that are created on the motor 26 and worm gear box 36.

Figure 9:
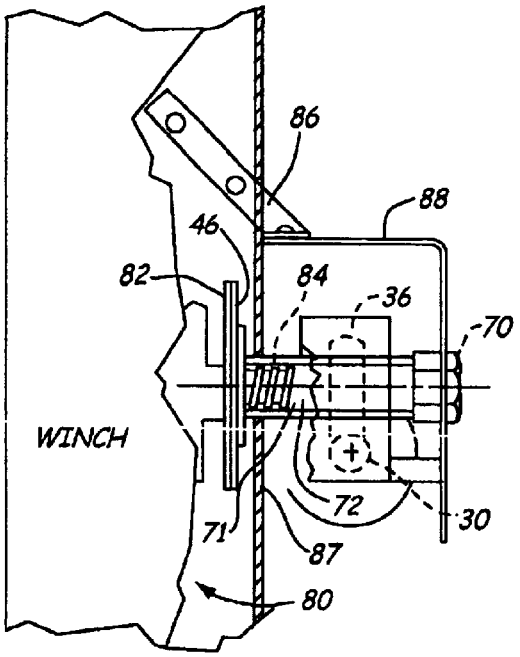
FIG. 9 is a fragmentary front elevational view of a drive unit made according to the present invention installed on a third type of boat lift winch box.
Figure 10:
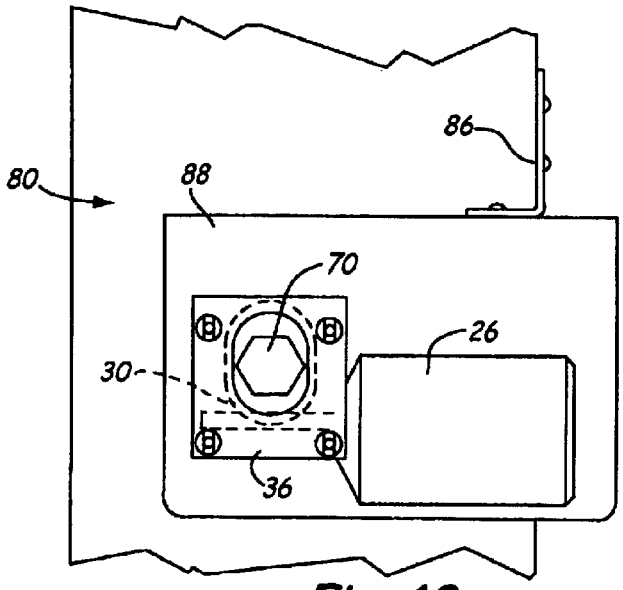
FIG. 10 is a fragmentary side view of the winch box of FIG. 9.
Figure 11:
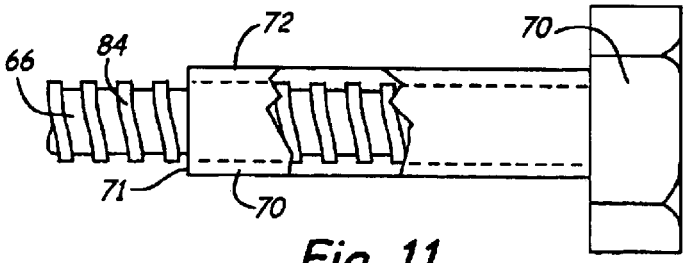
FIG. 11 is a side view of the nut used with the winch boxes shown in FIGS. 8 and 10.

FIGS. 9 and 10 show the third form of winch 80, and it can be seen that winch 80 has a drive plate 82 on an input drive shaft 84 which again is a threaded shaft. The nut 70 will be used for this type of drive as well. The threads on shafts 66 and 84 can be ⅞ inch acme threads, with the outer surface 72 of nut 70 a one-inch diameter. The bore of tubular shaft 34 is slightly larger than the surface 72 for a close sliding fit.

The flange or disc 38 has a surface or face that bears against the friction-disc 46 and forms a drive element for mating with the winch drive element for driving. If the winch shaft has a different coupling the flange 38 would be a mating drive element.

In the third form of winch 80, a suitable strap indicated at 86 can be used for reacting loads for stabilizing the frame 88, and the worm gear box 36 will be fastened to such a frame with straps with suitable brackets for reacting the loads.

The end of tubular gear box shaft 34 can be shimmed with suitable washers between the outer end of the shaft and the nut, or belville spring washers can be used to exert a sufficient amount of force on the friction disc 46 to drive the winch when the motor 26 is operated. The drive connection can be a coupling other than a friction disc, such as jaw clutch or a projection/receptacle drive.

The drive motor 26 and gear box, together with a friction disc 46 and at least one nut 58 or 70 comprises a boat lift winch conversion kit. The kit can include at least two nuts, as shown, for use with different winch shafts. The switch 60 also can be included in the kit.

While a worm gear box is shown and is preferred, other gear boxes between the motor and winch shaft can be used.

Although the present invention has been described with reference to preferred embodiments, workers skilled in the art will recognize that changes may be made in form and detail without departing from the spirit and scope of the invention.

What is claimed is:

1. A drive unit for placement onto an existing boat lift winch drive shaft having a first drive coupling element on the winch drive shaft, the winch drive shaft normally being driven by a manual wheel on the shaft, the drive unit comprising a gear box, a drive motor, said gear box including a first gear driven by the drive motor, and a second gear, an output shaft, the second gear being mounted on the output shaft, said output shaft being tubular and slidable over a winch shaft, a second drive coupling element fixed on one end of the tubular shaft on an exterior of the gear box, the second drive coupling element adapted to mate with a first drive coupling element on an existing boat lift winch drive shaft to drive such winch drive shaft, and a fastener to hold the tubular shaft onto an existing winch drive shaft with the second coupling element on the tubular shaft in driving engagement with a first drive coupling element on such winch drive shaft.

2. The drive unit of claim 1, wherein the fastener is a nut that threads onto an existing winch drive shaft and applies an endwise force on the tubular shaft.

3. The drive unit of claim 1, wherein the motor is a powered motor and a power source coupled to the motor.

4. The drive unit of claim 1, wherein the gear box tubular shaft has a length that extends out of the gear box on both ends of the shaft.

5. A power drive kit for placement onto an existing boat lift winch drive shaft, said kit including a gear box having an output shaft, said output shaft being tubular and extending to the exterior of the gear box, the output shaft having a disc generally perpendicular to the shaft and having a driving face surface, a friction disc of size to fit against the surface of the disc on said tubular shaft, and a nut for securing the tubular shaft onto a winch drive shaft with the tubular shaft placed to overlie a winch drive shaft, and the nut providing an axial force on the disc on the tubular shaft toward a mating disc on the winch drive shaft.

6. The kit of claim 5, wherein the gear box comprises a worm gear box, and a motor to drive a worm, the tubular shaft mounting a worm gear.

7. The kit of claim 5, wherein said nut has a head and a sleeve, the sleeve having an internal thread for threading onto a drive shaft of a winch.

8. The kit of claim 5, wherein there is a reversing drive motor driving the gearbox, and a switch included in the kit for controlling the motor from a power source in either direction of rotation.

9. The kit of claim 5, wherein a plurality of different nuts for mounting onto existing winch drive shafts are in the kit.

10. A worm gear drive box for mounting onto a shaft for driving the shaft through a clutch arrangement between the shaft and the worm gear drive box, said worm gear drive box comprising an integral motor thereon drivably coupled to a worm in the worm gear drive box, a tubular output shaft having an internal bore rotatably mounted on the worm gear box, a worm gear mounted on the tubular output shaft, a drive disc fixed on an outwardly extending end of the tubular output shaft, said drive disc having a drive face generally perpendicular to an axis of the tubular output shaft, and an end of said tubular output shaft opposite from the disc extending outwardly from the worm gear box and having an end surface against which a force can be applied to urge the drive disc in an axial direction of the tubular output shaft.

11. The worm gear drive box of claim 10, wherein said drive disc has a planar face surface perpendicular to a central axis of the tubular shaft.

* * * * *